US008074304B1

(12) United States Patent
Snyder

(10) Patent No.: US 8,074,304 B1
(45) Date of Patent: Dec. 13, 2011

(54) AQUA THERAPY AND RECREATION SPA WITH INTERCHANGEABLE EXERCISE EQUIPMENT

(76) Inventor: Christa J. Snyder, Marshfield, MA (US)

( * ) Notice: Subject to any disclaimer, the term of this patent is extended or adjusted under 35 U.S.C. 154(b) by 380 days.

(21) Appl. No.: 12/384,982

(22) Filed: Apr. 10, 2009

Related U.S. Application Data

(60) Provisional application No. 61/123,928, filed on Apr. 11, 2008.

(51) Int. Cl.
*A47K 3/00* (2006.01)

(52) U.S. Cl. ..... 4/541.1; 4/496; 482/54; 482/111

(58) Field of Classification Search ..... 4/496, 541.1–541.5; 482/54, 57, 482/111

See application file for complete search history.

(56) References Cited

U.S. PATENT DOCUMENTS

| | | | |
|---|---|---|---|
| 3,485,213 | A | 12/1969 | Scanlon |
| 4,332,217 | A | 6/1982 | Davis |
| 4,574,739 | A | 3/1986 | Fontaine et al. |
| 4,576,376 | A | 3/1986 | Miller |
| 4,712,788 | A | 12/1987 | Gaudreau, Jr. |
| 4,759,544 | A | 7/1988 | Diaz |
| 4,776,581 | A | 10/1988 | Shepherdson |
| 4,828,522 | A | 5/1989 | Santos |
| D304,222 | S | 10/1989 | Keller et al. |
| 4,938,469 | A | 7/1990 | Crandell |
| 4,944,506 | A | 7/1990 | Keller et al. |
| 5,060,935 | A | 10/1991 | Dunn et al. |
| 5,098,085 | A | 3/1992 | Abboudi et al. |
| 5,103,508 | A | 4/1992 | Counts |
| 5,108,088 | A | 4/1992 | Keller et al. |
| 5,116,295 | A | 5/1992 | Dunn et al. |
| 5,123,641 | A | 6/1992 | Abboudi et al. |
| 5,135,448 | A | 8/1992 | Dunn et al. |
| 5,217,420 | A | 6/1993 | Abboudi et al. |
| 5,295,929 | A | 3/1994 | Weisz |
| 5,316,532 | A | 5/1994 | Butler |
| 5,328,423 | A | 7/1994 | Abboudi et al. |
| 5,378,213 | A | 1/1995 | Quint |
| 5,379,467 | A | 1/1995 | Lochbaum |
| 5,487,713 | A | 1/1996 | Butler |
| D370,508 | S | 6/1996 | Drennan |
| D374,046 | S | 9/1996 | Drennan |
| 5,558,604 | A | 9/1996 | Hopkins |
| 5,586,961 | A | 12/1996 | Quint |
| 5,647,826 | A | 7/1997 | Butler |
| 5,665,039 | A | 9/1997 | Wasserman et al. |
| 5,752,899 | A | 5/1998 | Ballard |
| 5,807,216 | A | 9/1998 | Arad |
| 5,913,754 | A | 6/1999 | Lochbaum |
| 5,921,892 | A | 7/1999 | Easton |
| 5,951,447 | A * | 9/1999 | Butler ..... 482/111 |
| 6,001,071 | A | 12/1999 | Butler |
| D424,139 | S | 5/2000 | Gwin |
| 6,290,629 | B1 | 9/2001 | Vargas, III et al. |
| 6,383,121 | B1 | 5/2002 | Galasso et al. |
| 6,746,375 | B2 | 6/2004 | Smith et al. |
| 7,086,994 | B2 | 8/2006 | Turak et al. |
| 2005/0075222 | A1 | 4/2005 | Adley |
| 2005/0159275 | A1 | 7/2005 | Bullman et al. |
| 2008/0271236 | A1 * | 11/2008 | Truman et al. ..... 4/541.1 |

* cited by examiner

*Primary Examiner* — Charles Phillips
(74) *Attorney, Agent, or Firm* — John P. McGonagle

(57) ABSTRACT

A combination unit for hydrotherapy and exercise having a rubber dampening pad containing pre-drilled holes for the interchanging of exercise devices such as treadmills, bicycles, and elliptical machines. The unit has stairs for rear entrance and a clear splash guard for safe use indoors. The unit has a seat with shoulder and back jets located behind the seat, stability bars and a control panel. The control panel provides temperature control, aquatic jet flow, exercise equipment control and controls for MP3 players and the like. The unit has a water motor for driving certain exercise equipment.

9 Claims, 14 Drawing Sheets

AQUA THERAPY AND RECREATION SPA WITH INTERCHANGEABLE EXERCISE EQUIPMENT

CROSS-REFERENCE TO RELATED APPLICATIONS

Applicant claims the priority benefits of U.S. Provisional Patent Application No. 61/123,928, filed Apr. 11, 2008.

BACKGROUND OF THE INVENTION

This invention relates to the fields of aquatic therapy, exercise and recreation apparatus, and in particular, to a hydrotherapy tank with interchangeable exercise devices and using hydra power.

Current devices related to this invention include aquatic treadmill chambers; self-propelled or electrically-powered, stand-alone treadmills placed in a body of water, such as a tank or swimming pool; commercial in-ground therapy pools adapted for treadmills and lap swimming; spas holding treadmills; hydrotherapy tanks; and small portable hydrotherapy pools.

Spas used for recreation and massage, deep tank treadmill devises having a treadmill at the bottom of a deep tank of water, and in-ground pools cost over $100,000. Smaller in-ground pools for aqua therapy for use by patients with various illnesses, such as Multiple Sclerosis, are available, but have a cost of approximately $40,000.

The prior art discloses various smaller, less-expensive hydrotherapy tanks and pools using still water. The tanks can be used for running in place and/or other exercises.

The prior art also discloses a spa having a treadmill and water jets providing swimming resistance. See U.S. Pat. No. 7,086,994, issued Aug. 8, 2006 to John A. Turak. However, the Turak spa does not provide for interchangeable exercise equipment, a pump used to provide exercise resistance and assistance, and a water motor to assist in exercise training, and combination aqua therapy and exercise.

SUMMARY OF THE INVENTION

It is an object of the present invention to provide a small, affordable spa which is safe to use inside or outside the home. The spa of the present invention is a combination unit for hydrotherapy and exercise having a rubber dampening pad containing pre-drilled holes for the interchanging of exercise devices such as treadmills, bicycles, and elliptical machines. The unit has stairs for rear entrance and a clear splash guard for safe use indoors. The spa has a plurality of therapy jets powered by a pump. The spa also has a seat with shoulder and back jets located behind the seat, stability bars and a control panel. The seat is adapted for use also as a step for entry into the spa interior. The invention spa also has stability bars about the spa interior. Shoulder and back jets provide a combination of exercise and relaxation hydrotherapy in one device. The control panel provides temperature control, aquatic jet flow, exercise equipment control and controls for MP3 players and the like. The spa has a water motor for driving certain exercise equipment. The exercise equipment is hydro-powered with a pump and water motor providing both assistance and resistance to the exerciser.

The present invention spa can be used by someone with an illness such as Multiple Sclerosis providing cool temperature water and assistance during exercise. Water temperature can be raised for a professional athlete training or rehabbing an injury, choice of exercise equipment and resistance training.

The control panel within the spa provides temperature control, equipment control, electronic controls for various consumer entertainment products, and jet controls.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be made to the accompanying drawings and descriptive matter in which there is illustrated a preferred embodiment of the invention.

DETAILED DESCRIPTION OF THE INVENTION

Figure 2:
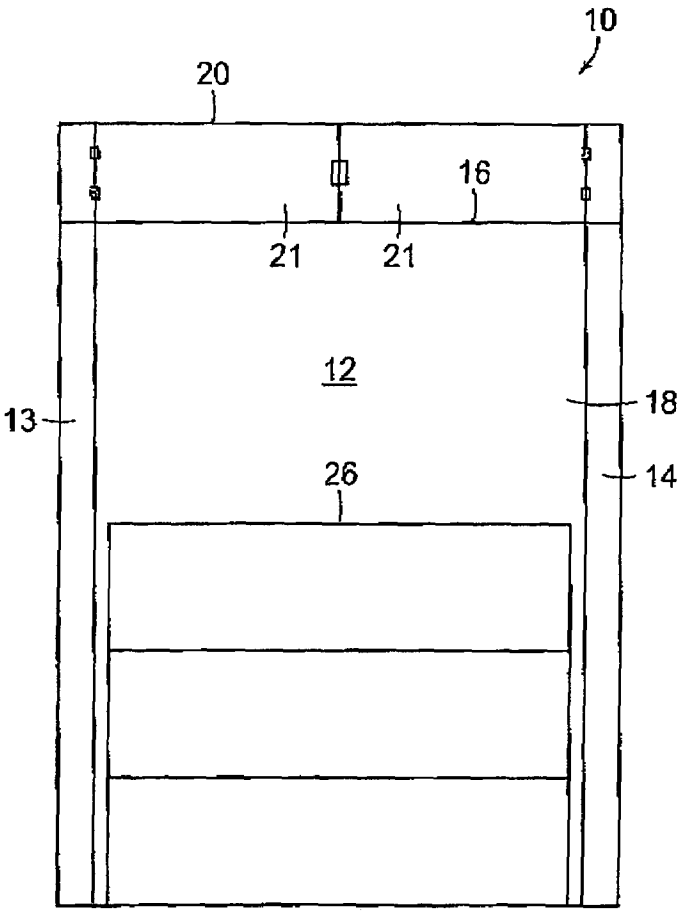
FIG. 2 is a rear view of the spa.

Referring to the drawings in detail wherein like elements are indicated by like numerals, there is shown a therapy spa 1 constructed according to the principles of the present invention. The therapy spa 1 is encased in a tank 10 having a front 11, a rear 12, a left side wall 13, a right side wall 14, a bottom 15, and an open top 16, said front, rear, left and right side walls and bottom defining a tank interior 17. The tank front 11 and rear 12 define a tank longitudinal axis. In a preferred embodiment of the invention the tank 10 is made from a high impact, flexible polymer. The tank is nominally 5'4" tall and 13'8" long, rear to front. The tank side-to-side width 13-14 is nominally 4'6" wide. The tank front 11 may be wider than the rear 12 to allow extra room for arm movement when exercising.

Figure 1:
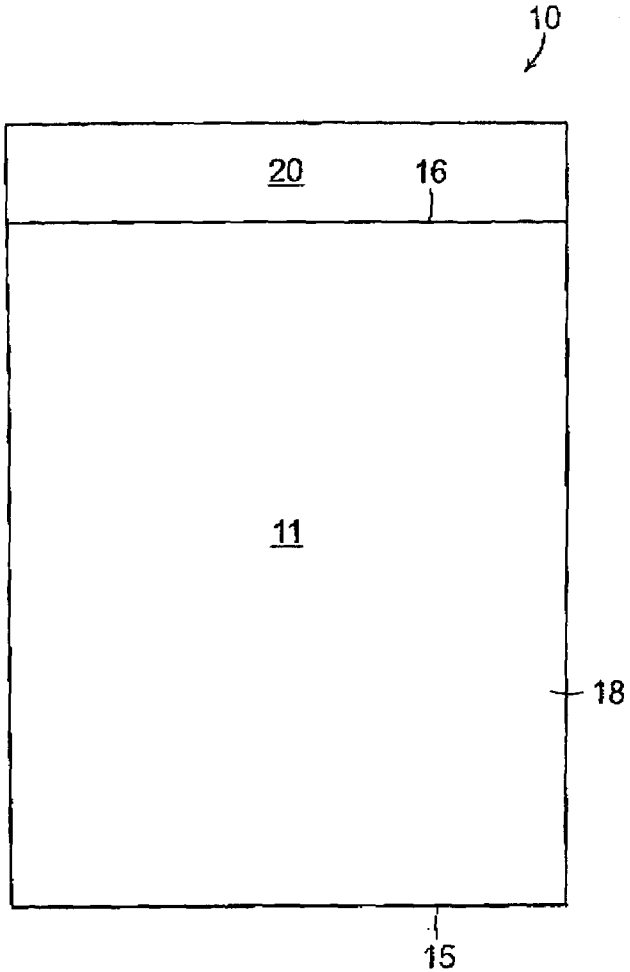
FIG. 1 is a front view of the spa.
Figure 3:
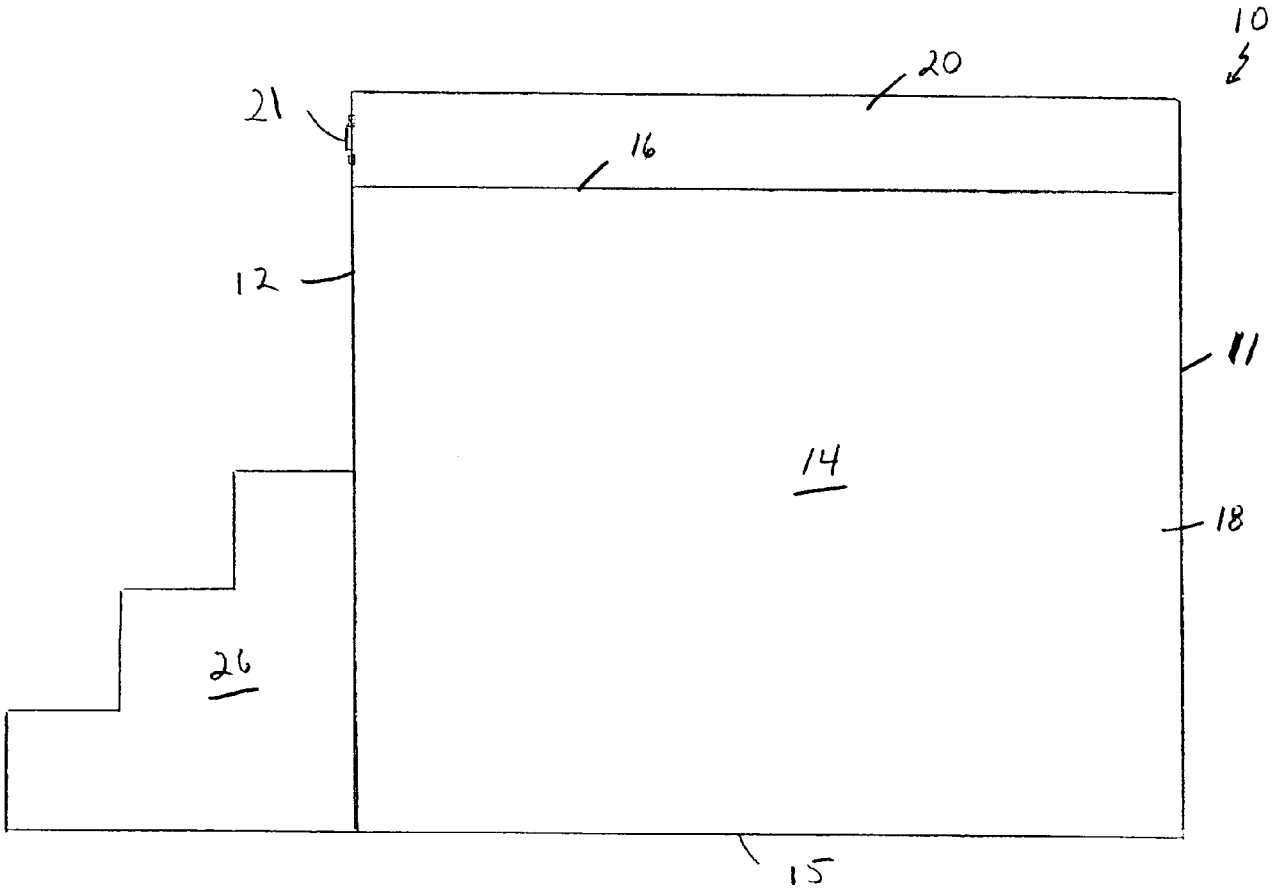
FIG. 3 is a right side view of the spa.

A splash guard 20 is fitted about the tank top on the front 11, left side wall 13, right side wall 14 and rear 12. The splash guard 20 is seamless, except for a hinged opening 21 at the tank rear 12. The hinged rear opening 21 facilitates entry into the tank interior 17. The splash guard 20 is preferably comprised of a clear plastic and protects against splashing while removing any claustrophobic feelings an exerciser in the tank interior 17 may feel. The splash guard 20 is approximately 8 to 10 inches high. An external step assembly 26 may be attached to the tank rear 12 outside the tank 10 to assist the exerciser in entering the tank. See FIGS. 1-3.

Figure 4:
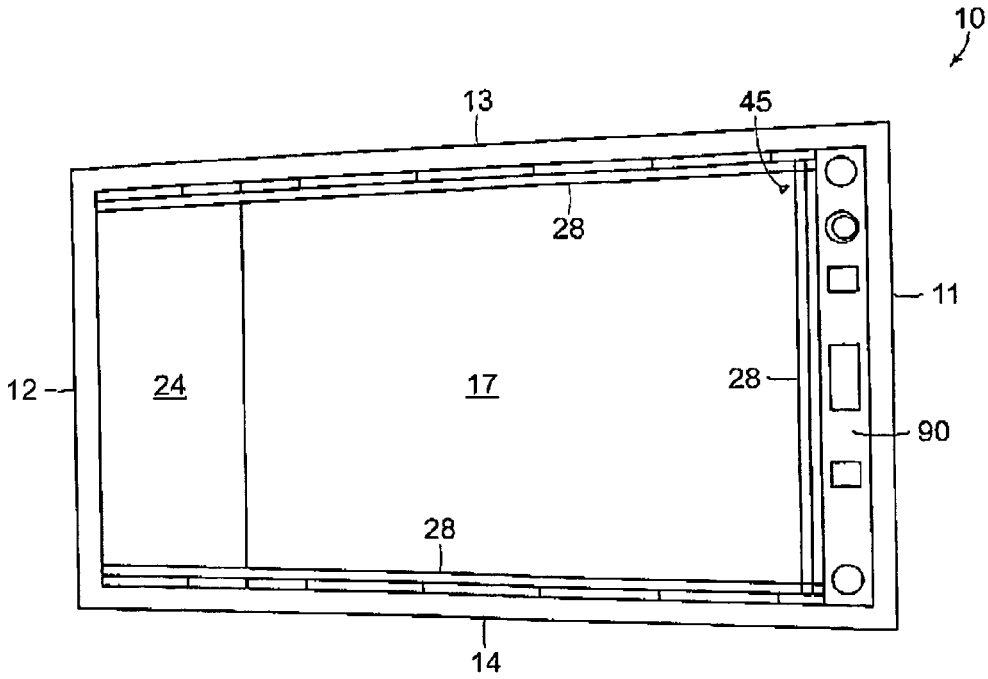
FIG. 4 is a top view of the basic spa tank structure.

The tank 10 is further comprised of a seat 24 formed on the tank rear 12 within the tank interior 17. The seat 24 provides a step to assist an exerciser to enter into the tank interior 17. An elongated stability bar 28 is horizontally positioned within the tank interior 17 adjacent the tank front 11 and along the side walls. See FIG. 4.

Figure 5:
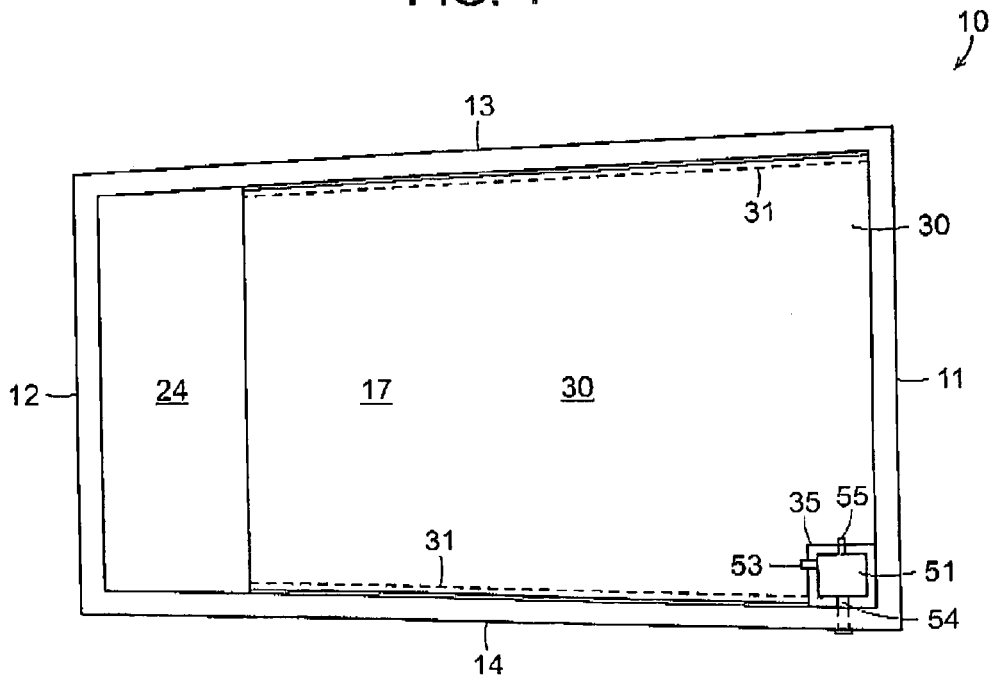
FIG. 5 is a top view of the spa tank, without stability bars and console, illustrating the dampening pad and water motor.

The therapy spa 1 is further comprised of a generally flat, dampening pad 30 in the tank interior 17 latched to the tank bottom 15. Alternatively, the pad may be attached to the tank bottom 15 by means of a water proof adhesive. The dampening pad extends from front 11 to rear 12, and from left side wall 13 to right side wall 14. The dampening pad 30 is constructed from a resilient, water-impervious material such as rubber. The dampening pad 30 is predrilled with a plurality of holes 31 adapted to provide attachment means 33 for various exercise equipment. The dampening pad 30 reduces vibration from exercise movement and protects both the tank and the exerciser from equipment and exerciser impact. See FIG. 5. Removable plugs are provided to seal unused dampening pad holes 31. Exercise equipment such as treadmill, bicycle, elliptical machines are interchangeably placed into the tank interior 17 and joined with the attachment means to the dampening pad 30.

Figure 7:
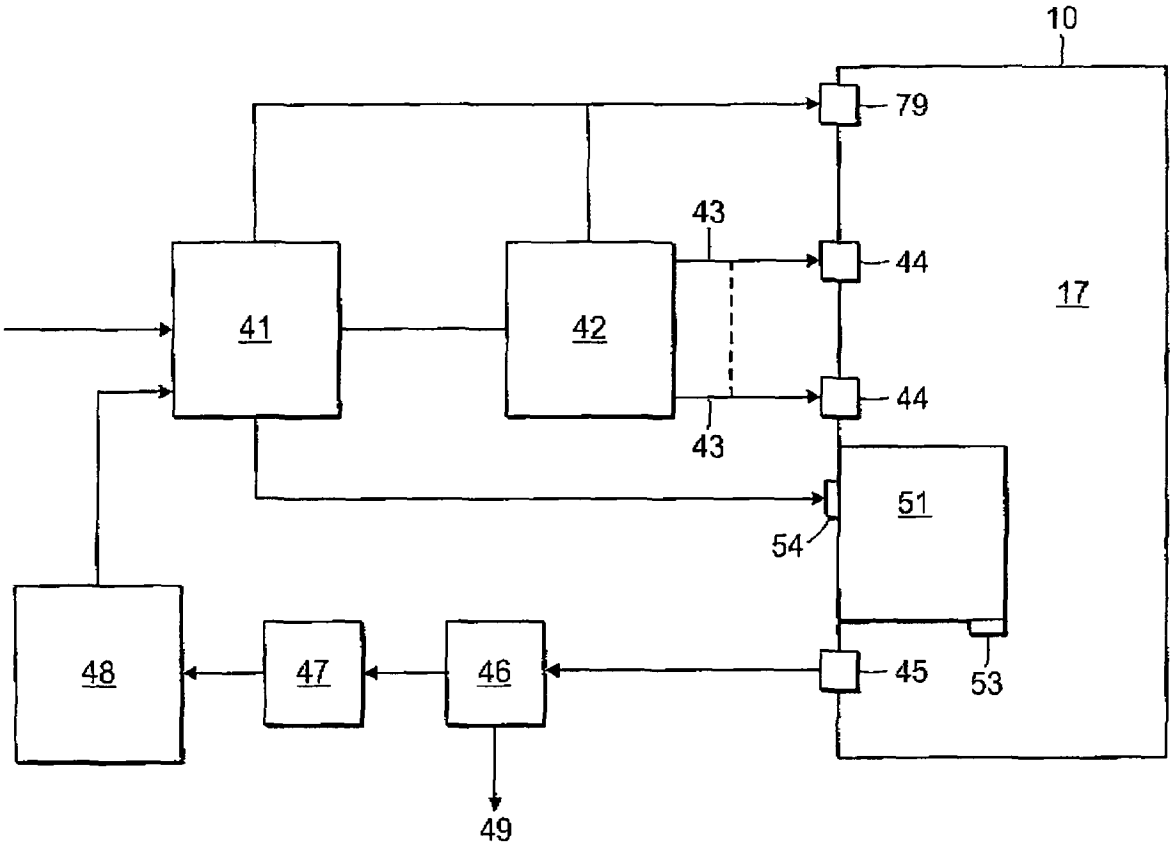
FIG. 7 is a block diagram of the water distribution system.

The therapy spa 1 has a water distribution system 40 comprised of a first water pump 41 having an input connected to a conventional water supply and a reservoir 48. The water pump 41 has an output connected to a water baffle system 42 from which a plurality of conduits 43 extend terminating in a plurality of jet openings 44 within the tank interior 17. The jet openings 44 are positioned about the tank interior 17 in the front 11, rear 12, left side wall 13 and right side wall 14. A return drain 45 is provided along one of the side walls 13, 14 adjacent the tank interior bottom 15. The return drain 45 brings water from the tank interior 17 back through a valve 46 into either a filtration module 47 connected to the water distribution system reservoir 48 or a conventional waste water output drain 49. See FIG. 7. The water distribution system 40 is further comprised of a reaction water motor 51 positioned within the tank interior 17 and driven by the water pump 41. An example of the type of a reaction water motor that could be used would be those manufactured by Gilbert Gilkes & Gordon, Ltd.

Figure 6:
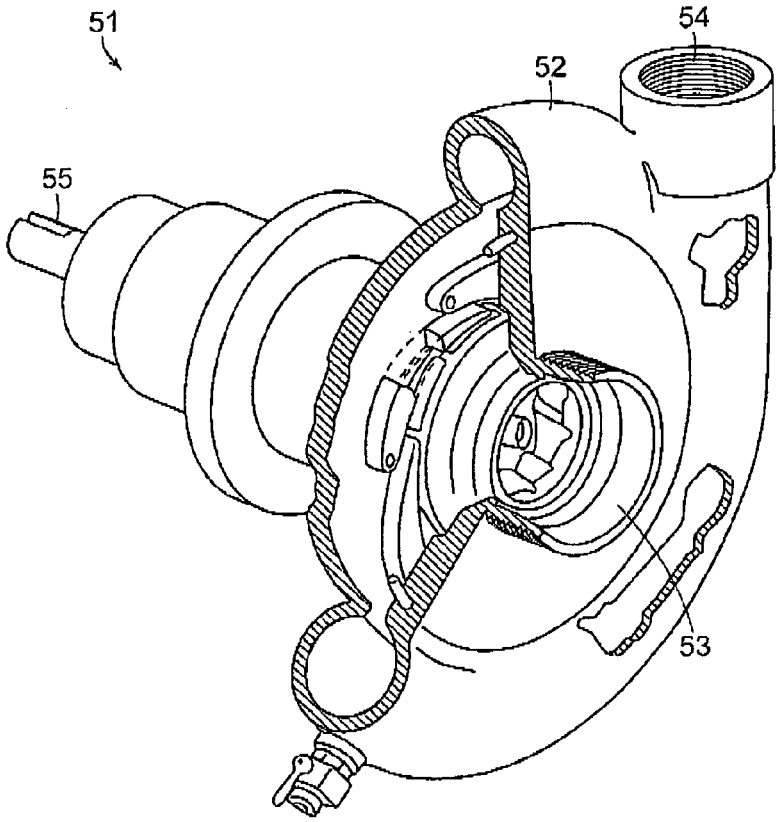
FIG. 6 is a view, partly in section, of the water motor.

The water motor 51 is based on a reaction design using a propeller turbine principle and generally consists of a small spiral casing 52 complete with bearings and seal housings in which a motor drive wheel is enclosed. Power is produced by water from the water pump 41 entering the casing via an inlet 54 and passing through a series of guide vanes spaced round the periphery of the drive wheel, then flowing through the drive wheel turning the drive wheel and attached shaft 55 thereby producing power before being discharged from the eye 53 of the wheel into the tank interior 17. See FIG. 6. The shaft 55 is used to drive various exercise equipment used in the tank. The water motor 51 is nominally positioned on and attached to a low shelf 35 adjacent the tank front 11 and right side wall 14. See FIG. 5.

Figure 8:
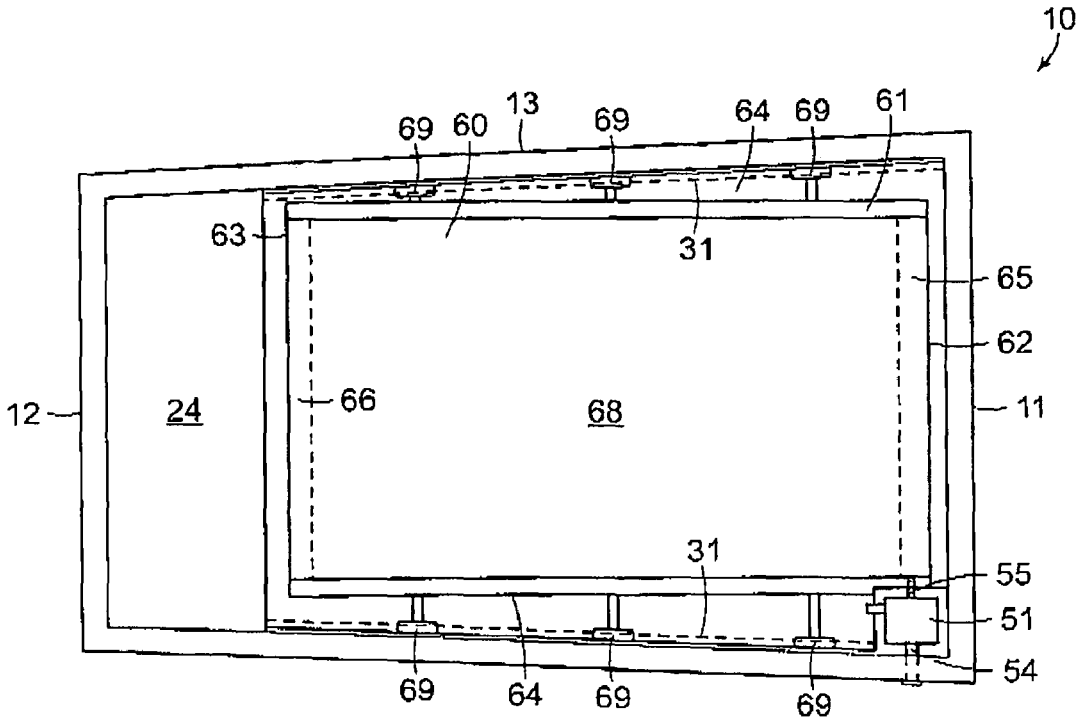
FIG. 8 is a top view of the treadmill positioned within the tank.
Figure 9:
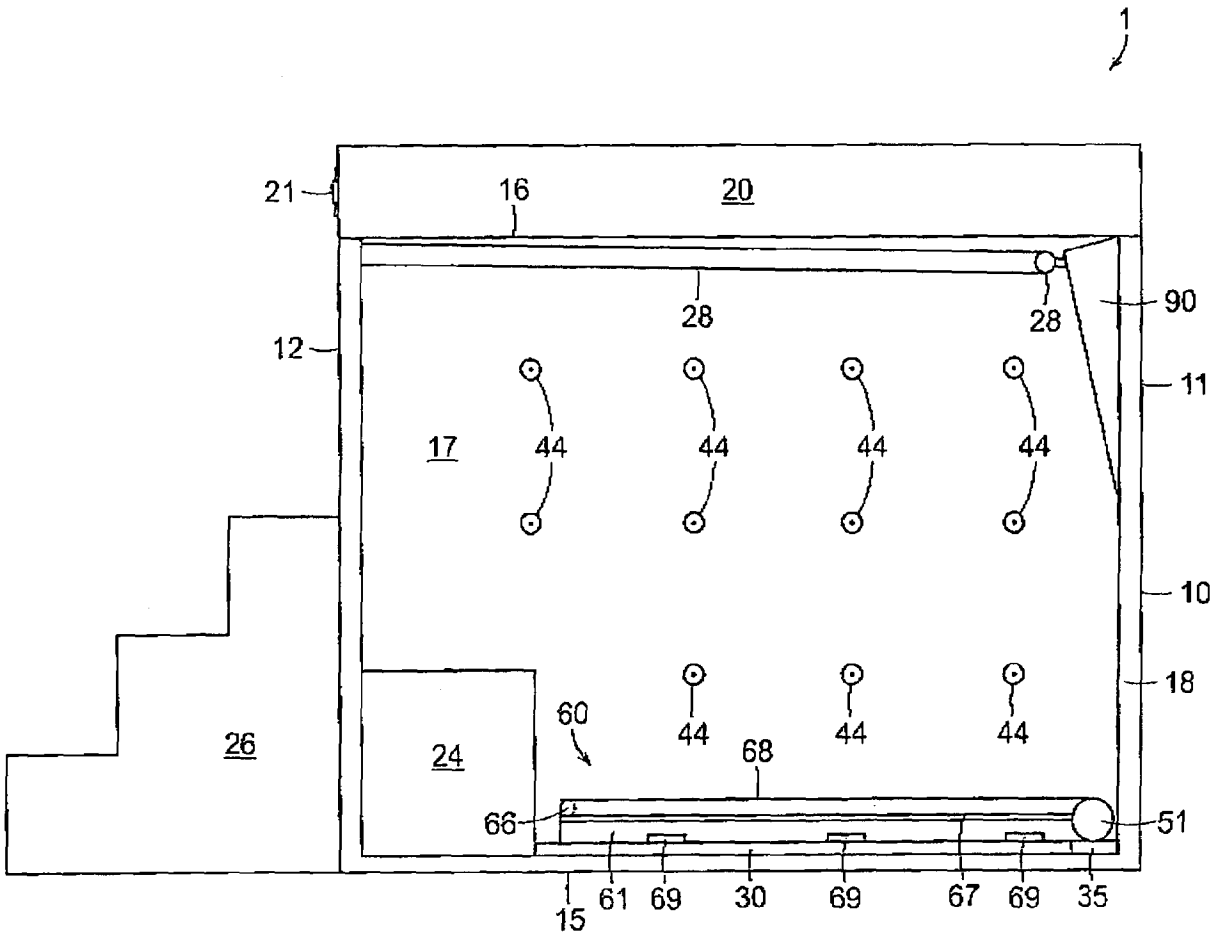
FIG. 9 is a side view of the treadmill positioned within the tank.

The treadmill 60 used with the therapy spa 1 is comprised of a base 61 having a forward end 62, rear end 63, two opposite and parallel sides 64, a forward roller 65, a rear roller 66, a cushioned support deck 67, and a rubber belt 68 looped about said forward and rear rollers 65, 66. Each of the rollers 65, 66 is rotatably connected to the opposite sides 64. The forward roller 65 is rotatably engaged with and driven by the water motor shaft 55. Treadmill speed is determined by the water motor 51. The rotation of the water motor 51, and thereby the torque provided to the water motor shaft 55, is controlled by the amount of water provided to the water motor from the water pump 41 through the water pump inlet 54. The water pump inlet has an opening which is controlled by the invention control panel 90. The treadmill base 61 is releasably attached to the dampening mat 30. The treadmill base 61 has a plurality of bracket flanges 69 distributed about the base perimeter and extending outward from the base, each bracket flange having a plurality of apertures formed therein. The bracket apertures align generally with the dampening pad holes 31. The attachment means 33 are comprised of camloc fasteners inserted through the bracket apertures into the dampening pad holes 31 thereby releasably attaching the treadmill base 61 to the dampening pad 30. See FIGS. 8 and 9.

The exercise equipment also includes an exercise bicycle 70 removably attached to the dampening pad 30. The exercise bicycle 70 is comprised of two horizontal base plates 71, one forward and one rearward, each with a longitudinal axis perpendicular to the tank longitudinal axis. The base plates 71 extend from the tank left side wall 13 to the tank right side wall 14. The base plates 71 have apertures 72 near their extremities, said apertures corresponding to the dampening pad holes 31. Attachment means 33 are used to removably attach the exercise bicycle base plates 71 to the dampening pad 30. A bicycle frame 73 is fixedly attached to the base plates 71. An adjustable seating post 74 extends upward from the frame 73 and terminates in a bicycle seat 75. The frame 73 also contains an aperture through which a pedal assembly 76 is attached. The stability bar 28 provides nominal handle bar support required for bicycle exercise. However, more traditional bicycle handle bar supports may be attached to the stability bar.

Figure 10:
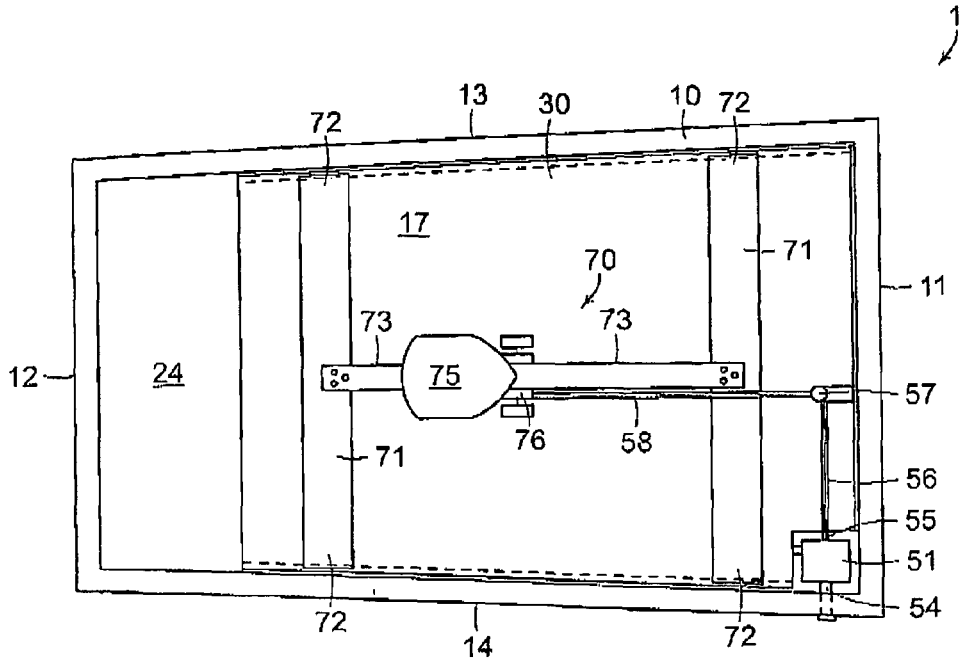
FIG. 10 is a top view of the bicycle positioned within the tank.
Figure 11:
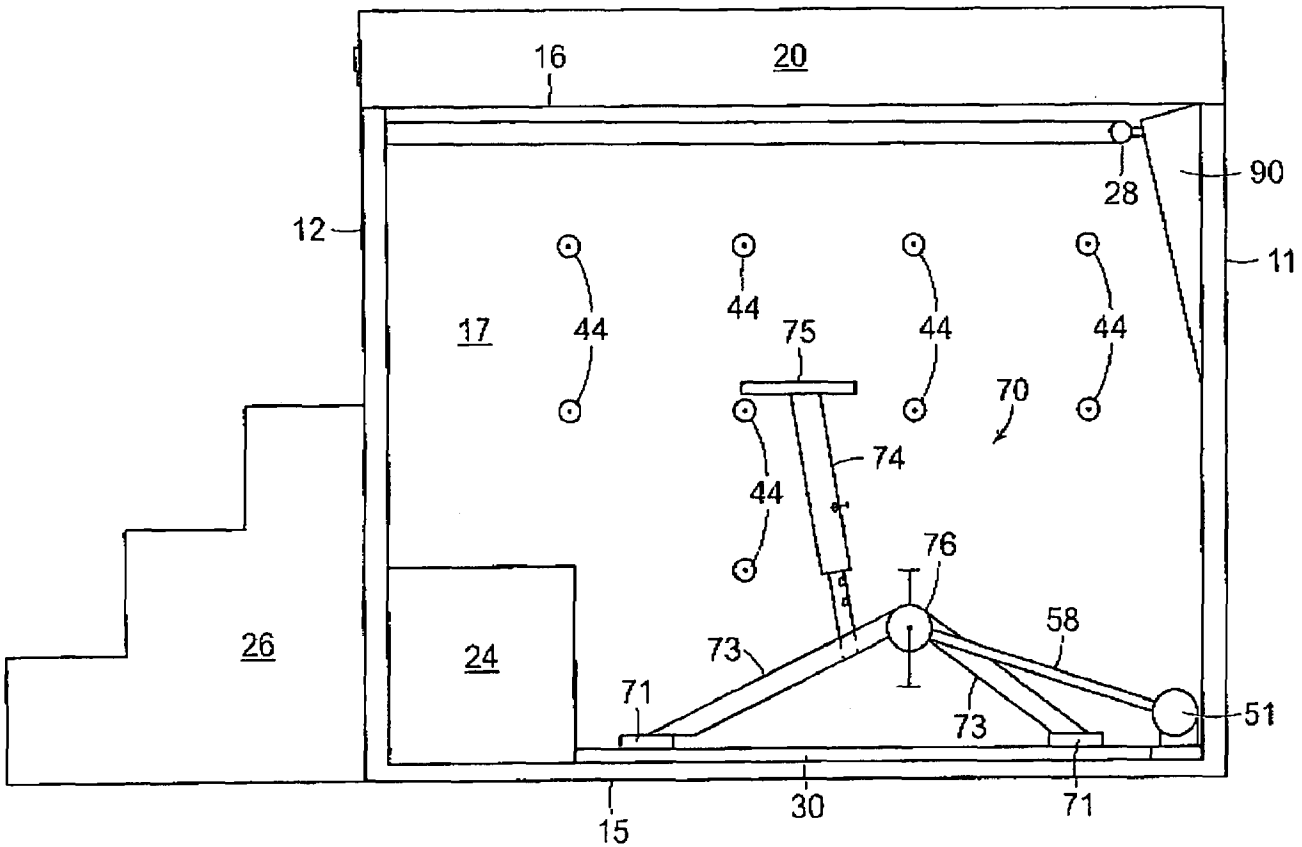
FIG. 11 is a side view of the bicycle positioned within the tank.

The water motor 51 applies a force on the pedal assembly 76. An elongated coupling attachment 56 is removably attached to the water motor shaft 55, said coupling attachment 56 having a longitudinal axis coincident with a water motor shaft longitudinal axis. The coupling attachment 56 terminates in a universal joint 57. A drive shaft 58 interconnects the coupling attachment universal joint 57 with the pedal assembly 76. The drive shaft 58 is of the type used for chainless bicycles, such as the chainless technology advertised by Dynamic Bicycles, Inc., Holliston, Mass. The drive shaft uses two sets of spiral bevel gears and a shaft rod to transfer power from the coupling attachment 86 to the pedal assembly 76. Water motor shaft 55 torque is translated through the coupling attachment 56 and the drive shaft 58 to the pedal assembly 76. See FIGS. 10 and 11.

In an alternative embodiment, a water exercise bicycle 100 may be driven directly by the water pump 41 bypassing the water motor 51. The water bicycle 100 is removably attached to either the dampening pad 30 or over the treadmill 60 onto the treadmill brackets 69. The water bicycle 100 is comprised of two horizontal base plates 71, one forward and one rearward, each with a longitudinal axis perpendicular to the tank longitudinal axis, centrally interconnected by means of an elongated base element 101. The base plates 71 extend from the tank left side wall 13 to the tank right side wall 14. The base element has a longitudinal axis coincident with the tank longitudinal axis. The base plates 71 have apertures 72 near their extremities, said apertures corresponding to the dampening pad holes 31 and/or the treadmill bracket apertures. Attachment means 33 are used to removably attach the exercise bicycle base plates 71 to the dampening pad 30 or treadmill brackets 69. Mounted on the base element 101 is a circular casing 102 enclosing a wheel 103 with a plurality of vanes 104 extending outwardly from a wheel perimeter. An axle 105 extends laterally through a wheel center and through the casing 102, said axle 105 being rotatably journaled to the wheel 103. The axle 105 terminates in two opposite ends which are attached to individual pedal assemblies 106. The casing 102 has two inlets, a drag inlet 107 near a casing top and a propulsion inlet 108 near a casing bottom. Each inlet 107, 108 is connected to a miniature baffle 109 on a tank side wall 13 or 14. The miniature baffle 109 is interconnected either directly to the water pump 41 or to the water distribution baffle system 42. The miniature baffle 109 controls water input to either the drag inlet 107 or to the propulsion inlet 108. Depending upon the water inlet engaged, the wheel 103 within the casing 102 is rotated either in a clockwise or counter-clockwise direction through engagement of the wheel vanes 104 by water flowing into one or the other inlets. Depending upon which inlet is in use, the other inlet becomes an acting discharge outlet. See FIGS. 14-17.

The exerciser would typically use the tank seat 24 to position himself/herself and engage the pedal assemblies 106. The exerciser would then select a wheel turning resistance through water pressure into the drag inlet 107 or wheel turning assistance through water pressure into the propulsion inlet 108. The stability bar 28 could act as conventional handle bars. The exercise bicycle may also have handle bars attached to the stability bar 28. A hollow, cylindrical, vertical element 110 is attached to the base element 101 adjacent the casing 102. This permits the use of an optional bicycle seat 75 attached to a seating post 74 which is removably inserted into the vertical element 110. See FIG. 15.

Figure 12:
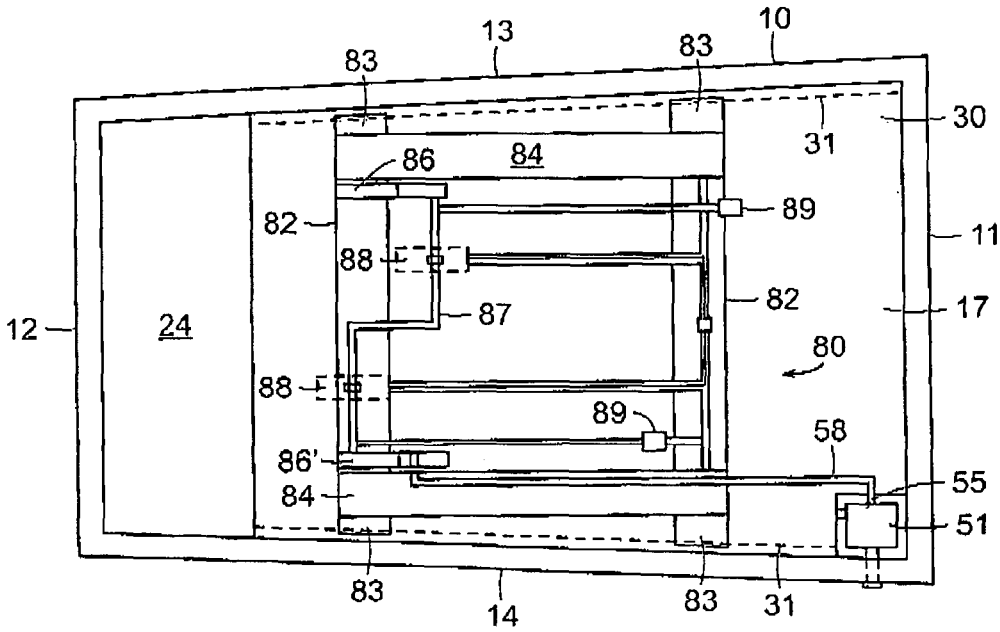
FIG. 12 is a top view of the elliptical machine positioned within the tank.
Figure 13:
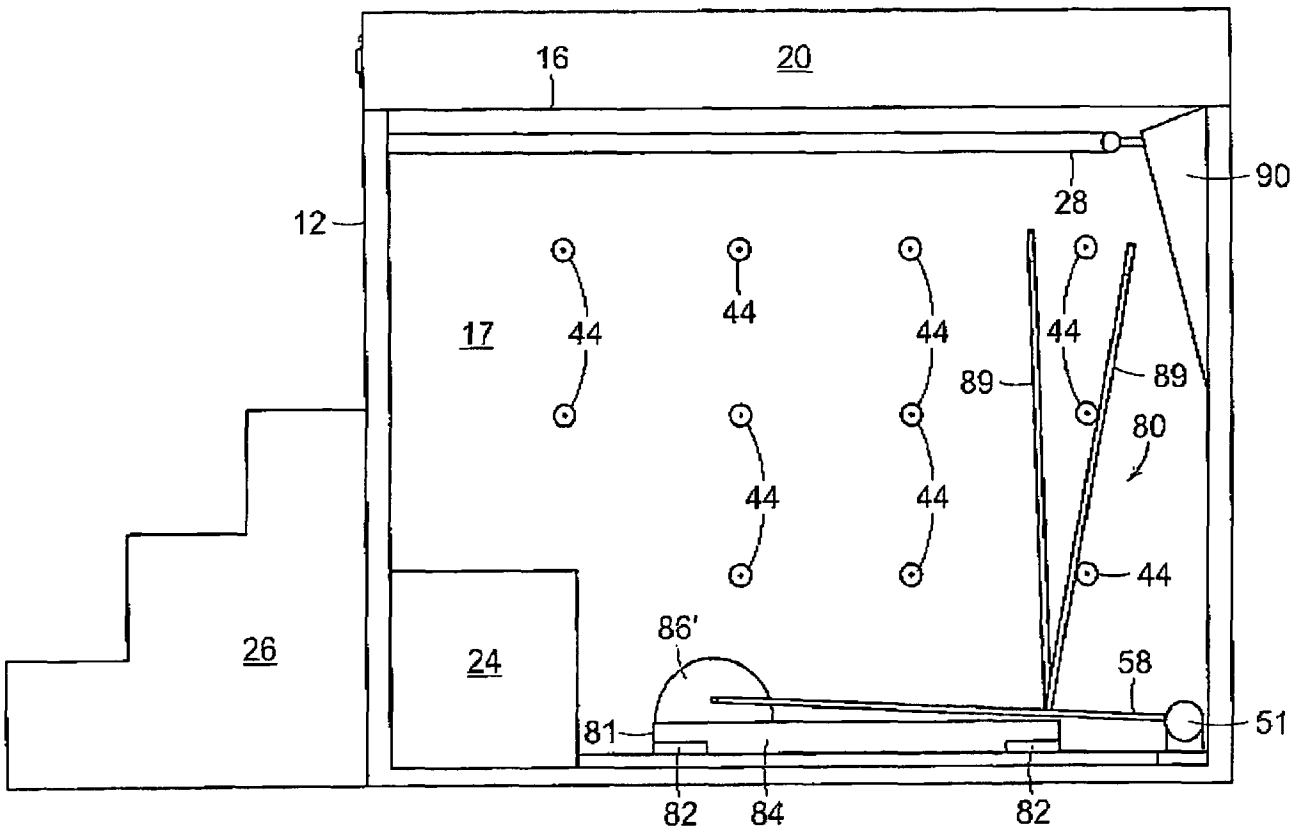
FIG. 13 is a side view of the elliptical machine positioned within the tank.
Figure 14:
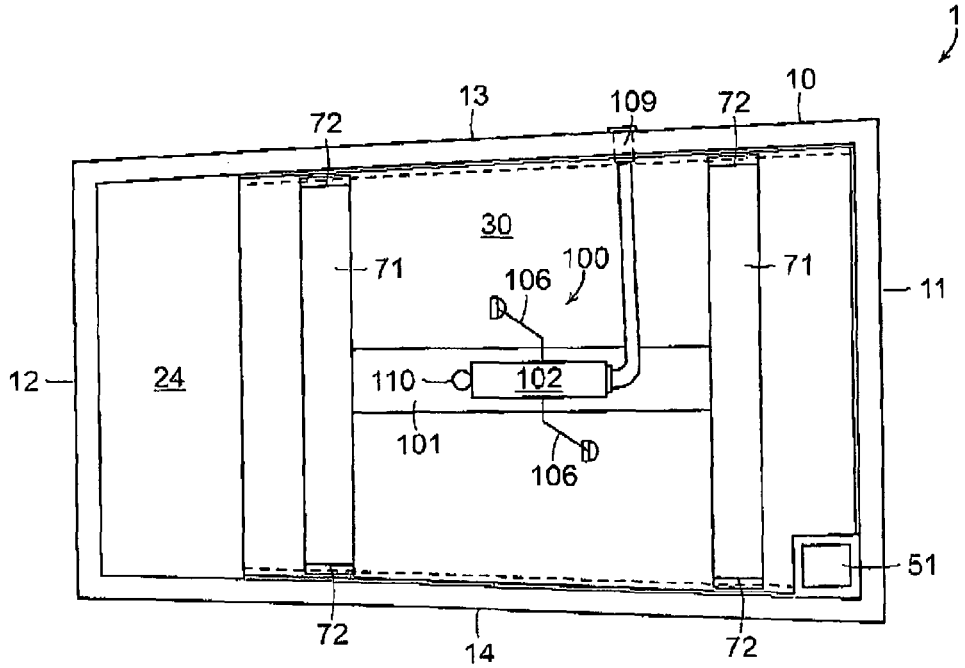
FIG. 14 is a top view of an alternate embodiment of the bicycle positioned within the tank.
Figure 15:
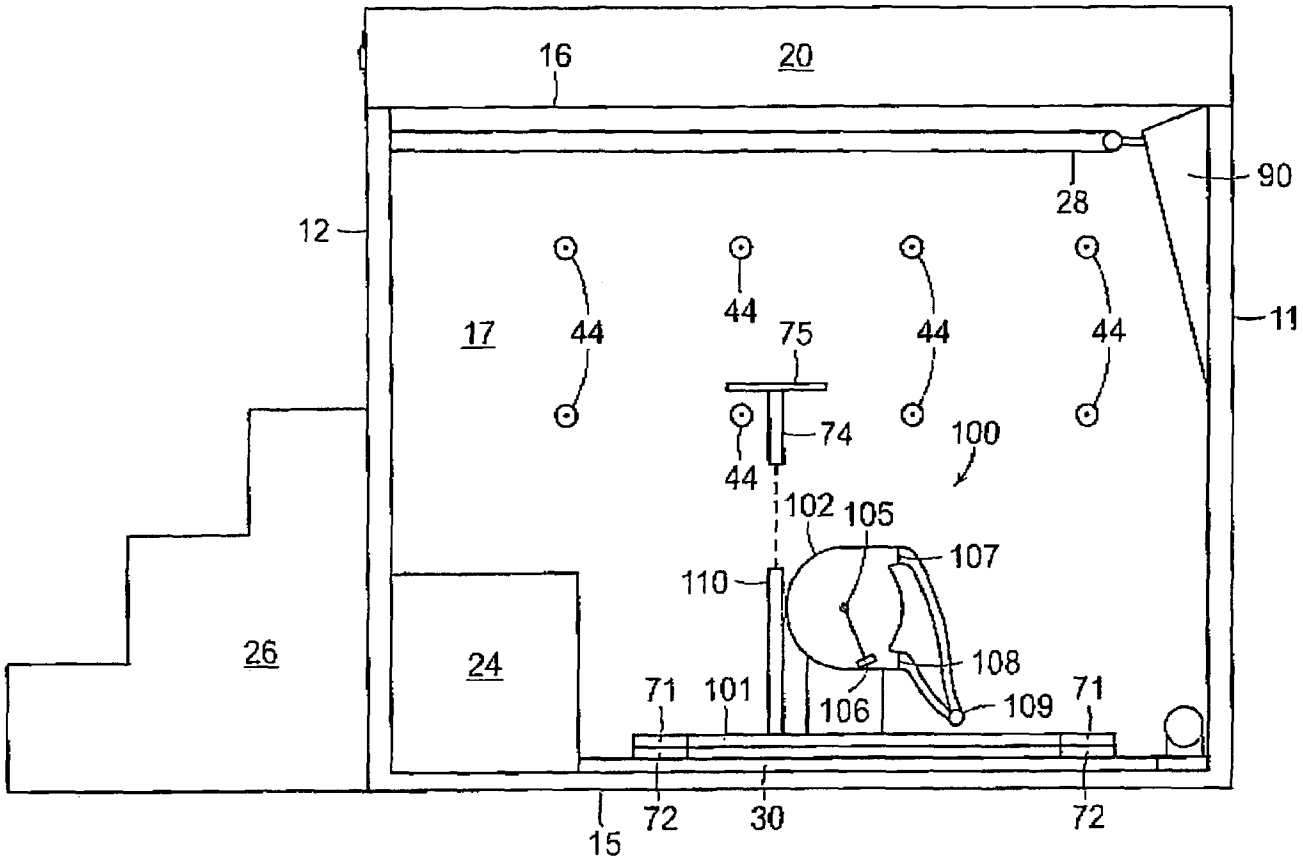
FIG. 15 is a side view of the alternate embodiment bicycle positioned within the tank.
Figure 16:
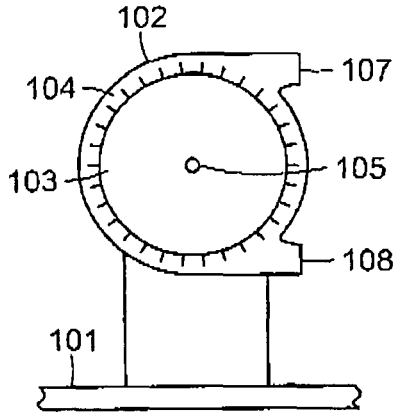
FIG. 16 is a cross sectional view of the bicycle casing.
Figure 17:
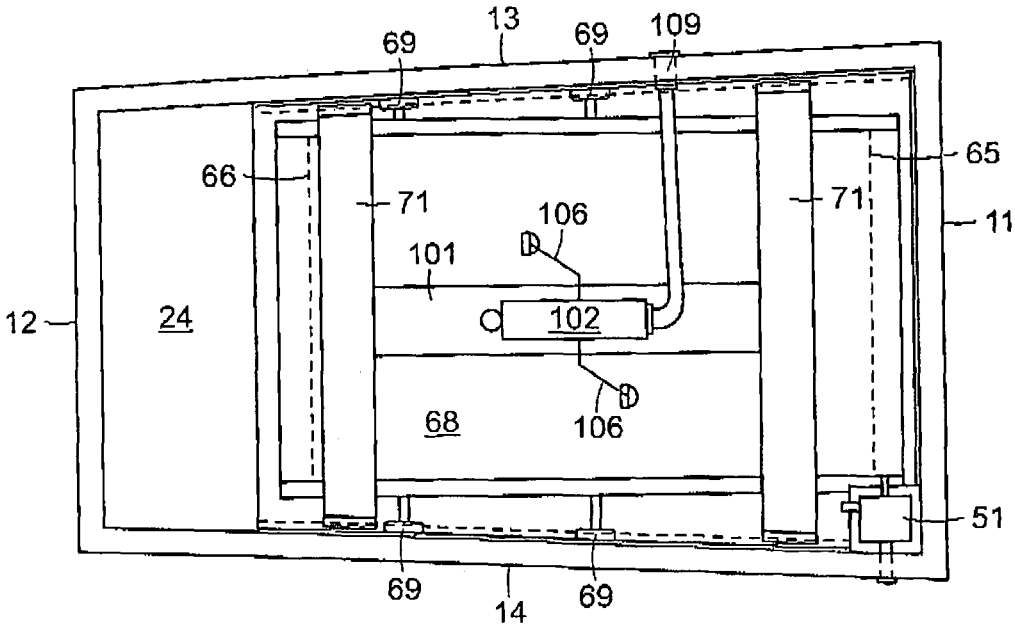
FIG. 17 is a top view of the alternate embodiment bicycle installed over the treadmill.

The exercise equipment also includes an elliptical machine 80 removably attached to the dampening pad 30. The elliptical machine has a base 81 comprised of two horizontal cross plates 82, one forward and one rearward, each with a longitudinal axis perpendicular to the tank longitudinal axis. The cross plates 82 extend from the tank left side wall 13 to the tank right side wall 14. The cross plates 82 have apertures 83 near their extremities, said apertures corresponding to the dampening pad holes 31. Attachment means 33 are used to removably attach the elliptical cross plates 82 to the dampening pad 30. The elliptical base 81 is further comprised of two elongated, horizontal support bars 84 attached to the cross plates 82, said each said support bar having a longitudinal axis coincident with the longitudinal axis of the tank 10. The support bars are positioned near to the tank side walls 13, 14. The elliptical machine 80 is further comprised of two wheels 86 journaled to the support bars 84. A crankshaft 87 interconnects the wheels 86. The water motor 51 applies a force to one of the wheels 86'. A drive shaft 58 interconnects the water motor drive shaft 55 wheel 86'. The drive shaft 58 may be the same as used with the bicycle 70 or may be a drive shaft of a different length. Water motor shaft 55 torque is translated through the drive shaft 58 to the elliptical wheel 86'. The crankshaft 87 moves foot pedals 88 up and down in the normal fashion. Typical pole handles 89 are also provided. See FIGS. 12 and 13.

The therapy spa 1 has a control panel 90 mounted in the tank interior 17 on the front 11 adjacent the tank top 16. A supplementary control panel 90' may be mounted adjacent the tank seat 24. The control panel 90 provides command control to the water distribution baffle system 42 for adjusting water pressure and selection of jet openings, to the water motor 51 for adjusting treadmill speed, and to the miniature baffle 109 for selection of drag or propulsion as well as amount of pressure for the exercise bicycle. Command control is also provided to the valve 46 for returning water to the water distribution system 40 or for draining the tank 10. Other capabilities may also be provided to the control panel, such as power to personal electronic devices, lighting, etc.

It is understood that the above-described embodiment is merely illustrative of the application. Other embodiments may be readily devised by those skilled in the art which will embody the principles of the invention and fall within the spirit and scope thereof. For lightness, all exercise equipment metal parts are preferably made from carbon fiber.

I claim:

1. An aqua therapy and recreation spa, comprising:

a tank having a front, a rear, a left side wall, a right side wall, a bottom, and an open top, said front, rear, left and right side walls and bottom defining a tank interior, said tank interior adapted to hold a designated amount of water;

a generally flat, dampening pad in the tank interior attached to the tank bottom, extending from tank front to tank rear, and from tank left side wall to tank right side wall, said dampening pad having a plurality of holes adapted to provide attachment means for various exercise equipment;

a water distribution system comprising:

a first water pump having an input connected to a conventional water supply and a reservoir, said first water pump having an output connected to a water baffle system from which a plurality of conduits extend and terminate in a plurality of jet openings within the tank interior;

a return drain along one of said the side walls adjacent the tank interior bottom, said return drain adapted to bring water from the tank interior back through a valve into either a filtration module connected to the water distribution system reservoir or a conventional waste water output drain;

a reaction water motor positioned within the tank interior and driven by said first water pump;

a treadmill comprising:

a treadmill base having a forward end, rear end, two opposite and parallel sides, said treadmill base being releasably attached to the dampening mat;

a cushioned support deck attached to said treadmill base;

a forward roller rotatably connected to the base opposite sides, said forward roller being rotatably engaged and driven by said reaction water motor;

a rear roller rotatably connected to the base opposite sides; and a rubber belt engaging said forward and rear rollers;

an exercise bicycle comprising:

a bicycle base having a forward end, rear end, two opposite and parallel sides, said exercise base being releasably attached to either the dampening pad or to the treadmill base;

a circular casing mounted on the bicycle base, said casing enclosing a wheel with a plurality of vanes extending outwardly from a wheel perimeter;

an axle extending laterally through a wheel center and being rotatably journaled to the casing, said axle having two opposite ends, each end terminating in a peddle arrangement exterior to said casing;

wherein said casing has two inlets, a drag inlet near a casing top and a propulsion inlet near a casing bottom, each said inlet being connected to a miniature baffle interconnected to said first water pump.

2. An aqua therapy and recreation spa as recited in claim 1, further comprising:

a main control panel mounted in the tank interior on the tank front adjacent the tank top; and a plurality of electronic control lines electrically connected to said control panel and terminating at said first water pump, said water baffle system, said valve, said reaction water motor, and said miniature baffle.

3. An aqua therapy and recreation spa as recited in claim 2, further comprising:

a seat formed on the tank rear within the tank interior; and an elongated stability bar horizontally positioned within the tank interior adjacent the tank front and attached on each end to the left and right side walls.

4. An aqua therapy and recreation spa as recited in claim 3, further comprising:

a splash guard fitted about the tank top on the tank front, left side wall, right side wall and tank rear, said splash guard having a hinged opening at the tank rear.

5. An aqua therapy and recreation spa as recited in claim 4, wherein:

said reaction water motor is comprised of a spiral casing with bearings and seal housings in which a motor drive wheel is enclosed, said motor drive wheel having a plurality of guide vanes spaced round a motor drive wheel periphery, said drive wheel having an attached drive shaft, said drive shaft being joined to said treadmill forward roller, wherein water from the first water pump is directed into said spiral casing via an inlet and is passed through said plurality of guide vanes, then flowing through the drive wheel turning the drive wheel and attached shaft and out through an axial outlet into the tank interior.

6. An aqua therapy and recreation spa as recited in claim 5, wherein:

the treadmill base has a plurality of bracket flanges distributed about a treadmill base perimeter and extending outward from the treadmill base, each bracket flange having a plurality of apertures formed therein, said bracket apertures being aligned generally with the dampening pad holes;

wherein a plurality of fasteners are inserted through said bracket apertures into the dampening pad holes thereby releasably attaching the treadmill base to the dampening pad.

7. An aqua therapy and recreation spa as recited in claim 6, wherein:

the exercise bicycle base has a plurality of bracket flanges distributed about a bicycle base perimeter and extending outward from the bicycle base, each bracket flange having a plurality of apertures formed therein, said bracket apertures being align generally with the treadmill bracket flange apertures and the dampening pad holes, said bicycle base adapted to being attached via the bicycle base bracket flanges to either the treadmill bracket flanges or directly to the dampening pad holes by a plurality of fasteners inserted through said bicycle base bracket flange apertures and releasably terminating in said dampening pad holes.

8. An aqua therapy and recreation spa as recited in claim 7, further comprising:

a supplementary control panel mounted adjacent the tank seat, said supplementary control panel electrically connected in parallel with said main control panel to said plurality of electronic control lines.

9. An aqua therapy and recreation spa as recited in claim 8, further comprising:

a plurality of steps attached to the tank rear wall outside of said tank.

* * * * *